US005325279A

United States Patent [19]

Freelove et al.

[11] Patent Number: 5,325,279

[45] Date of Patent: Jun. 28, 1994

[54] PERSONAL LOCATING SAFETY DEVICE FOR MULTI-STORY BUILDING FIRES

[75] Inventors: Martin Freelove; Mark Freelove, both of 4421 W. McNab Rd., Unit 20, Pompano Beach, Fla. 33069

[73] Assignees: Anthony K. Freelove, Tamarac; Shandal Von Wood, Boca Raton; Mark Freelove; Martin Freelove, both of Tamarac, all of Fla.

[21] Appl. No.: 967,222

[22] Filed: Oct. 27, 1992

[51] Int. Cl.[5] ..... F21S 1/02

[52] U.S. Cl. ..... 362/145; 362/154; 362/253; 362/397; 40/597; 40/902; 116/202; 116/209; 340/321; 340/331; 340/574

[58] Field of Search ..... 340/331, 321, 574, 691, 340/693; 40/553, 591, 597, 902; 362/145, 125, 126, 154, 155, 156, 253, 397; 116/202, 209

[56] References Cited

U.S. PATENT DOCUMENTS

| | | | |
|---|---|---|---|
| 2,557,859 | 6/1951 | Bernstein | 340/331 |
| 3,913,092 | 10/1975 | Klingenberg | 340/331 |
| 4,129,857 | 12/1978 | Espinosa | 340/321 |
| 4,258,359 | 3/1981 | McLamb | 340/546 |
| 4,640,278 | 2/1987 | Barry | 128/206.12 |
| 5,059,952 | 10/1991 | Wen | 340/321 |
| 5,143,440 | 9/1992 | Trampota | 362/156 |
| 5,153,567 | 10/1992 | Chimento | 340/691 |
| 5,177,461 | 1/1993 | Budzyna et al. | 340/331 |

*Primary Examiner*—Ira S. Lazarus
*Assistant Examiner*—Alan B. Cariaso
*Attorney, Agent, or Firm*—Malin, Haley, DiMaggio & Crosby

[57] ABSTRACT

A portable personal locating safety device for use in multiple-storied or high-rise buildings for attachment to a window to allow ground observers to determine in which rooms occupants are trapped, especially during a fire. The device is adhered to a window and has an aperture with an illuminating flashing light attached therethrough. The kit contains internal compartments which house rolls of tape that can be used by trapped occupants to seal cracks around doors to reduce the intake of smoke until help arrives.

11 Claims, 1 Drawing Sheet

PERSONAL LOCATING SAFETY DEVICE FOR MULTI-STORY BUILDING FIRES

BACKGROUND OF THE INVENTION

1. Field of the Invention

This invention relates to personal safety devices for use in multi-story building fires and in particular, for a device to aid firefighters to determine which rooms in a multi-story building are occupied by inhabitants during a fire and in particular, to a portable, low-cost visual personal alert device that can be readily implemented during a fire for locating specific rooms that are inhabited during the fire and to provide a reduced smoke environment for the inhabitants while awaiting rescue.

2. Description of the Prior Art

Multi-story and high-rise buildings such as hotels, motels, office buildings or the like pose many threats to human life and welfare, especially during a fire. Intense smoke usually fills the building and it can be impossible for occupants to easily escape. Flames and intense heat also trap occupants on particular floors and in specific rooms. Many people trapped in multi-story office buildings cannot readily exit through windows because of the height above the ground, the fall from which would also be hazardous or fatal. The primary rescue techniques often include escape by emergency equipment provided by firefighters, such as extendable ladders which can reach various heights of the building to provide egress for trapped occupants in rooms through windows. When addressing a large, multi-story building fire however, firefighters have the problem of attempting to locate trapped victims in specific rooms so that they can determine where to direct the safety escape equipment. Most often, the rooms are smoke-filled, making it very difficult for occupants to continually stand by a window and get the attention of ground-based people. Often because of the smoke intensity, it is difficult to even see a person waving from upper floor windows.

Various types of systems have been devised to enhance the safety of occupants of multi-story buildings in the event of a devastating fire.

U.S. Pat. No. 4,640,278, issued to John C. Berry on Feb. 3, 1987, entitled "EMERGENCY AIR ACCESS AND SIGNAL," describes an emergency air access box typically attached to a window that includes an air tube or breathing tube and a light that can be directed out of the window. Such a unit is a costly, permanent attachment, and detracts from the everyday use of the windows.

U.S. Pat. No. 4,258,359, issued to Philip McLamb on Mar. 24, 1981, entitled "PORTABLE PROTECTIVE DEVICE," shows a portable device that has a smoke alarm that is portable and acts to sense combustion products or intrusion detection. The device is not made to provide a warning signal for locating trapped occupants in a room, but to provide for a warning of combustible materials or intruders.

The present invention provides a specific portable, low-cost device that includes an illuminating flashing light that can be readily and quickly attached to any window surface. Further, the housing includes rolls of tape that can be used by the trapped occupants to seal cracks around doors to reduce the intake of smoke until help arrives or until escape is possible.

SUMMARY OF THE INVENTION

In general, the invention provides a portable safety personal locating device for use in multiple storied or high rise buildings for attachment to a conventional window to allow ground observers to determine particular windows, and therefore rooms, in which occupants are trapped, especially during a fire.

The safety device is in the form of a kit, and includes a lightweight housing formed with integral front, rear, side, top, and bottom walls, the front wall having an aperture with a light attached therethrough, permanently mounted in the front or first wall. The wall structure may be made of cardboard or other lightweight plastic or paper material for a low-cost yet rigid structure.

One or more conventional suction cups are attached to the first wall containing the light source facing outwardly so that the entire lightweight housing can be attached by suction cups to the desired window through which the light will be shone to ground observers.

The housing may be rectangular in shape and includes a back housing flap as its rear wall and internal compartments as follows.

One internal compartment will include a shelving arrangement for one or more rolls of tape. The tape preferably includes a firm adhesive which can readily be used to seal up doorway cracks to prevent smoke from entering the room. Another compartment will include batteries and a relay circuit connected to the light, thereby allowing the light to flash, and an on/off switch to allow the light to be turned on and off when desired. The switch is mounted in the compartment back wall on the inside of the housing. The back housing flap must be opened to allow exposure to the on/off switch, the battery compartment and the compartment with the rolls of tape.

It is therefore one object of this invention to provide an improved safety device to allow occupants of a multi-story building to signal to ground rescue crews the location of occupants in a building that is on fire or has sustained a similar natural disaster.

It is another object of this invention to provide an improved portable safety device that can be constructed at low cost and is simple to install and use by occupants in a smoke-filled building for discovery by rescue personnel.

And yet still another object of this invention is to provide a highly portable, easily storable device that does not take up much space and has its own self-contained power system that can be utilized in an emergency by occupants in a hotel room or the like to aid in their location.

But yet still another object of this invention is to provide a safety device for use in high-rise fires, to protect occupants against smoke and to provide for expediting the location of occupants contained in rooms with a low-cost device that can be readily mounted on outside windows.

In accordance with these and other objects which will be apparent hereinafter, the instant invention will now become described with particular reference to the accompanying drawings.

DESCRIPTION OF THE PREFERRED EMBODIMENTS

Figure 3:
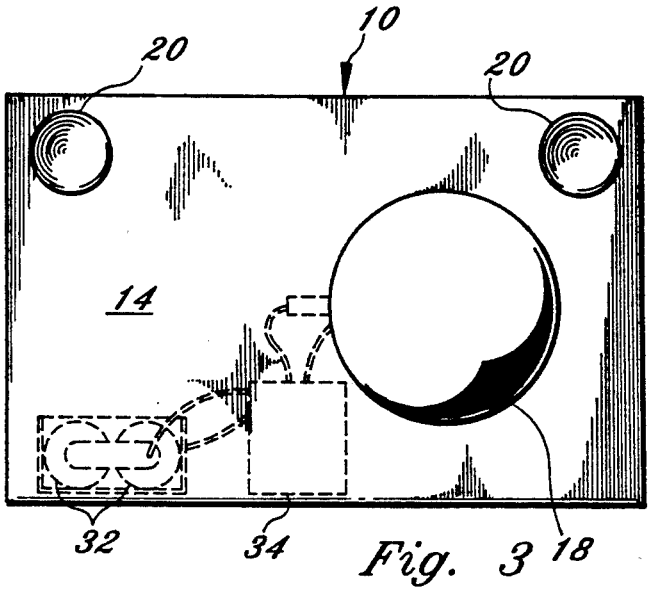
FIG. 3 shows a front elevational view pictured through a pane of glass of the present invention.
Figure 2:
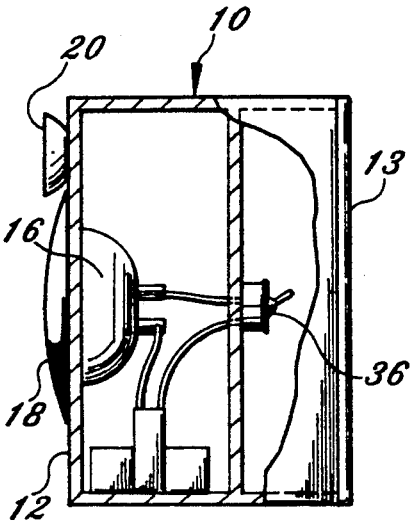
FIG. 2 shows a side elevational view partially in cross section of the present invention.

As shown in the accompanying drawings, the safety device includes a rectangular, boxlike housing 10 having a first wall 12 with a signal light comprising a light bulb (not shown), a light housing 16 and lens 18 attached therethrough. In the preferred embodiment, the signal light is of the strobe variety. The first wall 12 of the housing 10 is attached to a windowpane 14 at any convenient location and is secured thereto by suction cups 20, allowing the signal light to face outwardly of the desired window through which the light will be shone to ground observers.

The housing 10 may be made of any suitable material such as cardboard, paper, or lightweight plastic.

Figure 4:
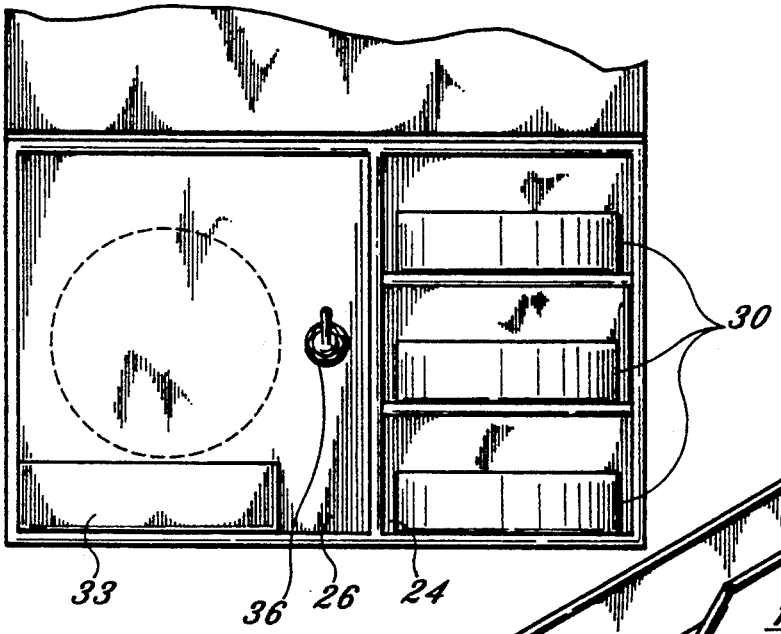
FIG. 4 shows a rear elevational view with the rear flap of the housing raised showing the present invention.
Figure 1:
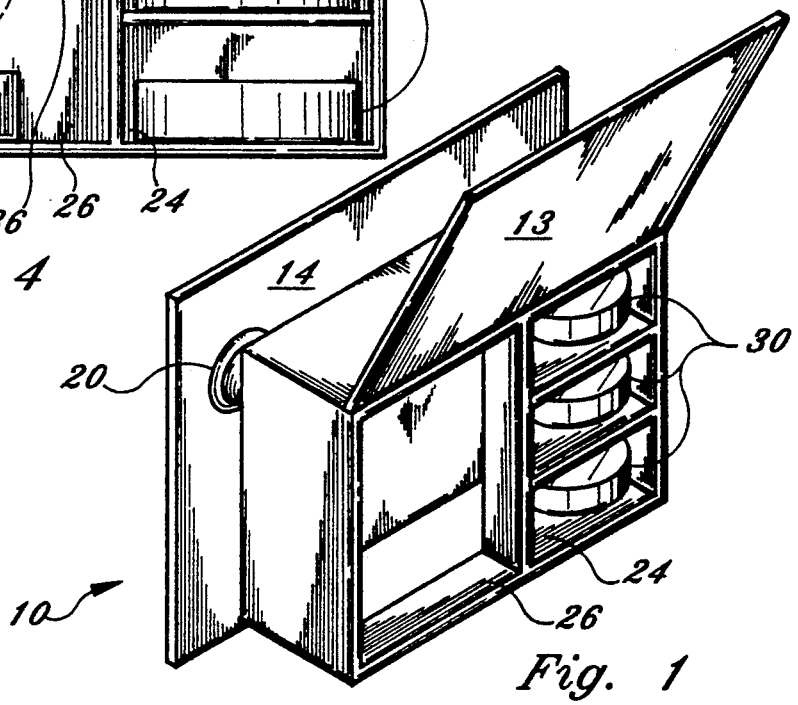
FIG. 1 shows a perspective view with the rear flap of the invention raised and mounted on a cutaway view of a window pane.

As seen in FIGS. 3 and 4, housing 10 may include a plurality of internal compartments as follows. A first internal compartment 24 preferably includes a shelving arrangement disposed therein for one or more rolls of tape 30. The tape 30 is used to seal doorway cracks to prevent smoke from entering the room. A second internal compartment 26 includes batteries 32 and a relay circuit 34 connected to the light. An on/off switch 36 is mounted in the second compartment 26 back wall.

The outer lens 18 for the light source may be made in an amber color for greater smoke penetration of the light rays and may provide some light focusing for ground observation. The light housing 16 may be a conventional concave or hemispherical housing with a standard bulb socket and bulb. The light housing 16 also may have the wiring necessary to connect it to a battery-powered source of electrical energy 32. In addition, a typical or conventional on/off switch 36 is provided to allow the light to be turned on and off when desired. A standard relay circuit 34 may be interposed to allow the light to flash on and off. The batteries 32 themselves are mounted in their own storage compartment 33 and are not readily accessible except by raising a particular flap (not shown) necessary to reach the batteries on the inside of the housing 10.

The on/off switch 36 is envisioned as a simple mechanical switch cylinder in nature that is pushed with a spring load to allow the device to be turned on or to be turned off. Instructions underneath the switch itself merely say "push," which allows a user to quickly activate the light.

The construction of the device is low-cost so that the device may be used in each room and be cost effective for safety purposes.

In one embodiment, to reduce cost in construction, the light housing 16 has an annular indented ring portion that fits snugly against a large circular aperture cut in the first wall, the diameters of which are sized so that the light housing fits snugly there without additional attachment. The lens body 18 then is clearly visible through the aperture while the mounting requires no additional fasteners or adhesive.

The tape 30 utilized in the present invention can be any wide, two or more inch tape with sufficient sticky surface to adhere readily to both surfaces of doors and door jambs.

In the preferred embodiment, a foam tape is used, with a foam thickness of approximately one-eighth or one-quarter inch and a very sticky surface that is exposed by removing a plastic cover so that the enhanced foam greatly protects against smoke penetrating through the door jamb cracks.

In construction, the box may be made of any type of material and includes a back housing flap 13 that readily opens to allow access to the tape 30 and to the actuating switch 36 of the light.

The operation of the safety device in an emergency is as follows. Basically, in its unused mode, the device is a very small box that can be stored in a hotel room, office or other storage area within each room in a high-rise or multi-story building. For operation, the box is grasped and carried to the window to be used when searching for ground help. The box is then pushed against the window, wherein the suction cups attach readily to the window, supporting the entire box and housing, with the light lens facing outwardly. The back housing flap is then raised, providing access to the on/off switch which is then activated. Also, access by raising the back flap is provided to numerous rolls of tape that are then used to cover the cracks surrounding the doors in the room to prevent smoke from reaching the occupants. The flashing light will attract ground observers' attention, pinpointing the exact room containing occupants so that they can direct rescue equipment to that room area to allow safe egress by the occupants. The tape on the doors provides additional time for safe rescue of the occupants.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A personal locating safety device for use in a room with a window to aid firefighters in determining which rooms in a multi-story building are occupied during a fire, said device comprising:

housing means for storing a plurality of safety devices;

light means mounted within said housing for warning rescuers that there is a person where the safety device is located;

a light power source mounted in said housing and connected to said light means;

switch means for disconnecting said light means from said light power source; and at least one roll of adhesive foam tape, disposed within said housing, said tape having a substantial width for sealing cracks around a door in single unitary sections, in the interior of a room, to reduce the intake of smoke.

2. The personal locating safety device of claim 1, wherein said housing means comprises:

a first wall, said first wall having an aperture with said light means attached therethrough;

a first internal compartment, said first compartment having a shelving arrangement disposed therein for storing said sealing means;

a second internal compartment, said second compartment having a back wall, said second compartment further having a third internal compartment disposed therein, said third compartment containing said power source;

a rear wall, said rear wall being movable to thereby leave a portion covered by said rear wall open to provide access to said safety devices; and means for securing said first wall to the window.

3. The personal locating safety device of claim 2, wherein said means for securing is a suction cup.

4. The personal locating safety device of claim 2, wherein said switch means is mounted in said second compartment's back wall.

5. The personal locating safety device of claim 2, wherein said second compartment further includes a relay means disposed therein, said relay means being connected to said power source, said relay means further being connected to said light means, thereby allowing said light to flash when said switch means is activated.

6. The personal locating safety device of claim 1, wherein said power source is a battery.

7. The personal locating safety device in claim 1, wherein said housing means is formed with integral front, rear, side, top, and bottom walls.

8. The personal locating safety device in claim 7, wherein said housing is made of plastic.

9. The personal locating safety device in claim 7, wherein said housing is made of cardboard.

10. A personal locating safety device for use in a room with a window to aid firefighters in determining which rooms in a multi-story building are occupied during a fire, said device comprising:

housing means for storing a plurality of safety devices, said housing having a first wall, said first wall having an aperture;

light means mounted within said housing for warning rescuers that there is a person where the safety device is located, said light means mounted such that the light shines through the aperture in said first wall;

a light power source mounted in said housing and connected to said light means;

switch means for disconnecting said light means from said light power source;

at least one roll of adhesive foam tape, disposed within said housing, said tape having a substantial width for sealing cracks around a door in single unitary sections, in the interior of a room, to reduce the intake of smoke; and means for securing said first wall to the window.

11. A personnel locating safety device for use in a room with a window to aid firefighters in determining which rooms in a multi-story building are occupied during a fire, said device comprising:

housing means for storing a plurality of safety devices, said housing having a first wall, said first wall having an aperture, said housing further having a plurality of internal compartments, said housing further having a rear wall, said rear wall being movable to thereby leave a portion covered by said rear wall open to provide access to said safety device;

light means mounted within said housing for warning rescuers that there is a person where the safety device is located, said light means mounted such that the light shines through the aperture in said first wall, said light means being of the strobe type;

a light power source mounted in said housing and connected to said light means;

switch means for disconnecting said light means from a power source, said switch means being mounted in one of said internal compartments' rear wall;

at least one roll of adhesive foam tape, disposed within said housing, said tape having a substantial width for sealing cracks around a door in single unitary sections, in the interior of a room, to reduce the intake of smoke; and means for securing said first wall to the window, said means for securing being a suction cup.

* * * * *